US006857773B1

(12) United States Patent
Wadensten

(10) Patent No.: US 6,857,773 B1
(45) Date of Patent: Feb. 22, 2005

(54) COMPRESSED GAS OPERATED ORBITAL ROLLING MEMBER VIBRATOR HAVING LOW NOISE PROPERTIES

(76) Inventor: Theodore S. Wadensten, 75 Stillson Rd., Wyoming, RI (US) 02898

( * ) Notice: Subject to any disclaimer, the term of this patent is extended or adjusted under 35 U.S.C. 154(b) by 141 days.

(21) Appl. No.: 10/338,186

(22) Filed: Jan. 8, 2003

(51) Int. Cl.[7] ..... B01F 11/00
(52) U.S. Cl. ..... 366/124; 366/126
(58) Field of Search ..... 366/108, 124–126, 366/128; 74/61, 87

(56) References Cited

U.S. PATENT DOCUMENTS

| | | | | |
|---|---|---|---|---|
| 2,480,603 | A * | 8/1949 | Peterson | 366/126 |
| 2,518,250 | A | 8/1950 | Peterson | |
| 2,875,988 | A * | 3/1959 | Wysong | 366/124 |
| 2,917,290 | A | 12/1959 | Peterson | |
| 2,960,316 | A * | 11/1960 | McKellar | 366/124 |
| 3,154,293 | A * | 10/1964 | Matson | 366/125 |
| 3,400,913 | A * | 9/1968 | Matson | 366/125 |
| 3,870,282 | A * | 3/1975 | Wadensten | 366/124 |
| 3,932,057 | A * | 1/1976 | Wadensten | 366/124 |
| 4,389,120 | A * | 6/1983 | Wadensten | 366/126 |
| 4,428,678 | A * | 1/1984 | Lyle | 366/124 |
| 4,604,029 | A * | 8/1986 | Fink | 415/92 |
| 5,314,305 | A * | 5/1994 | Fink | 415/202 |
| 6,244,815 | B1 * | 6/2001 | Treat | 415/54.1 |

* cited by examiner

*Primary Examiner*—David Sorkin
(74) *Attorney, Agent, or Firm*—Patrick J. Pinto

(57) ABSTRACT

A compressed air or gas operated vibrator that has a cylindrical housing with a raceway located and formed therein. The raceway is sized and shaped for guiding a rolling member along an orbital path. The vibrator also includes at least one removable end cap for closing any open ends of the housing. The cylindrical housing has an inlet port for directing a flow or jet of the compressed gas to and towards a selected point of the raceway. The vibrator also has an outlet port for exhausting gas from the housing. The vibrator further includes a turbine wheel that rotates inside of the housing with a predetermined clearance. The turbine wheel has a plurality of blade members formed along its outer diameter and a recess portion that is formed into its outer diameter for allowing the rolling member to reside therein while also allowing the rolling thereof. The turbine wheel with the rolling member residing therein rotates interior of the housing by the action of the compressed gas flowing from the inlet port thereby generating an unbalanced vibratory motion with low noise.

14 Claims, 2 Drawing Sheets

FIG. 5
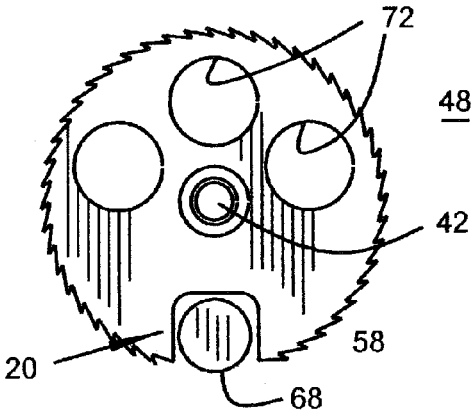
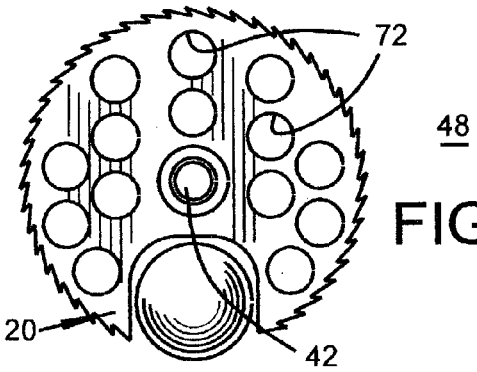
FIG. 7
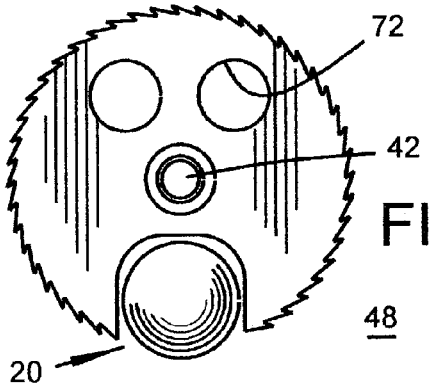
FIG. 6
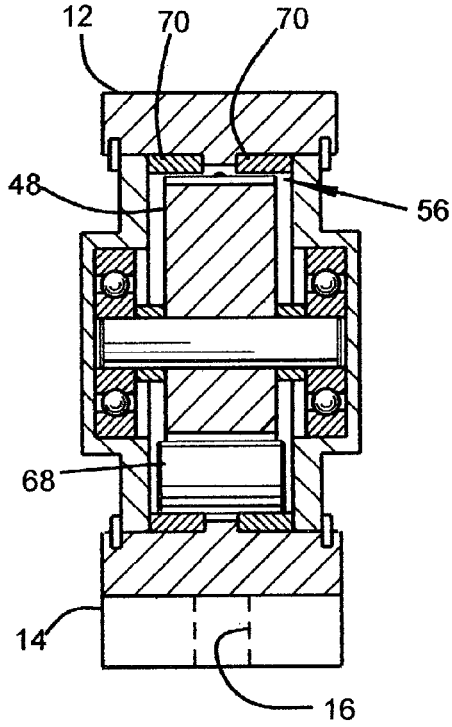
FIG. 4

COMPRESSED GAS OPERATED ORBITAL ROLLING MEMBER VIBRATOR HAVING LOW NOISE PROPERTIES

CROSS REFERENCE TO RELATED APPLICATION

Not Applicable

STATEMENT REGARDING FEDERALLY SPONSORED RESEARCH OR DEVELOPMENT

Not Applicable

BACKGROUND OF THE INVENTION

1. Field of the Invention

With regard to the classification of art, this invention is believed to be found in the general class entitled Agitating and more particularly to those subclasses pertaining to vibrators that are operated by a pressurized fluid that acts on an orbital rolling member such as a ball 2. Description of Related Art Orbital rolling element agitating means such as ball vibrators are well known in industry and or commerce for assisting in the discharge of flowable materials from bins, hoppers and the like. This same type of vibrator has also found use in compacting or settling of flowable materials in shipping containers such as; boxes, cartons, crates and the like. Examples of known ball vibrators are U.S. Pat. No. 2,518,250 that issued to Peterson on Aug. 8, 1950 and U.S. Pat. No. 2,917,290 that issued to Petersen on Dec. 15, 1959. A ball vibrator is a simple and effective machine element for creating a vibratory force. Basically, a ball of a selected size usually travels in a substantially orbital path around a circular chamber that is interior of a housing while under the impelling jet or flow of a compressed gas. One problem with the known ball vibrators is the high consumption of its operating fluid such as compressed air. The high consumption of a compressed operating fluid translates into high operating cost due to the consumption of energy such as electricity, fuel and the like that is used for operating an air compressor. Another problem that has been identified with known ball vibrators is the high noise level that develops after a short period of operation. This noise can be as high as 110 dB. This is not acceptable under current noise or sound guidelines. Many different approaches have been attempted to minimize the noise but none have been found to be effective. It is believed that the high noise is due to the operating characteristics of a ball vibrator. In operation, the velocity of the rolling ball varies as it travels on its orbital path in the housing. The highest acceleration of the orbiting ball occurs each time it approaches and passes the inlet air jet. The jet of compressed gas accelerates the ball while causing the ball to leave its raceway in a somewhat chord-like path. The impact of the ball returning to the raceway creates a pitting and most likely will result in damage to the surface of the ball even if the ball and the raceway are hardened. The resulting dents and/or surface damage to the ball and raceway create the noise as the ball orbits during normal operation. The only effective remedy for this condition is to replace the raceway and ball frequently. U.S. Pat. No. 2,917,290 referenced above attempted to address the wear problem with little success.

The present invention solves the problems or needs, identified above, by combining the low noise characteristics (72 dB) of the turbine type of vibrator with the rapid start characteristics of a ball vibrator. The present invention also has resulted in lower air consumption due to the fact that volume of the empty cavity interior of the housing is minimized. The present invention also minimizes the acceleration of the rolling member or ball at the point that it approaches and passes the air jet due to the action of the turbine wheel and its stabilizing effect. The present invention results in the minimizing of damage to the ball and the raceway therefore reducing its operating noise level.

SUMMARY OF THE INVENTION

The present invention may be described with respect to its objects. It is an object of the present invention to provide and it does provide a ball vibrator that minimizes it consumption of a compressed gas or fluid.

It is another object of the present invention to provide and it does provide a ball vibrator that minimizes the acceleration of the ball in the vicinity of the compressed gas inlet jet thereby reducing damage to the ball and its associated raceway.

It is yet another object of the present invention to provide and it does provide a ball type of vibrator that minimizes the noise output when and while in operation.

It is still yet another object of the present invention to provide and it does provide a ball vibrator that provides a rapid start while providing a relatively uniform velocity of the orbiting ball around its raceway.

The present invention may be briefly described as: a compressed air or gas operated vibrator that includes: a housing is that generally cylindrical while having a raceway located and formed therein. The raceway is sized and shaped for guiding a rolling member or ball along an orbital path interior of the housing. The vibrator also includes a first end cap for closing a first end of the housing and a second end cap for closing a second end of the housing. At least one of either the first end cap or second end cap is removably retained on the housing. The cylindrical housing further includes at least one inlet port for directing a flow or jet of the compressed gas to and towards a selected point of the raceway. The vibrator also includes an outlet port for exhausting gas from the housing. The vibrator further includes a turbine wheel that is carried on a shaft that extends from the first end cap to the second end cap. The shaft is selectively positioned for allowing rotation of the turbine wheel interior of the cylindrical housing with a predetermined clearance there-between. The turbine wheel has a plurality of blade members formed along its outer diameter. The turbine wheel further includes a recess portion that is formed into its outer diameter while being selectively sized for allowing the rolling member to reside therein while allowing the rolling thereof. The turbine wheel with the rolling member residing therein rotate interior of the housing by the action of the compressed gas flowing from the inlet port thereby generating an unbalanced vibratory motion. The turbine wheel minimizes unwanted acceleration of the ball as and when the orbiting rolling member is acted upon by the compressed gas at the location of the inlet port for minimizing damage to the rolling member and/or the raceway.

In addition to the above summary, the following disclosure is intended to be detailed to insure adequacy and aid in the understanding of the invention. However, this disclosure, showing particular embodiments of the invention, is not intended to describe every new inventive concept that may arise. These specific embodiments have been chosen to show at least one preferred or best mode for a ball vibrator of the present invention. These specific embodiments, as shown in the accompanying drawings, may also include diagrammatic symbols for the purpose of illustration and understanding.

BRIEF DESCRIPTION OF THE DRAWING

FIG. 4 represents a side elevation of a second alternate embodiment of the present invention, this view being in section and taken in the same direction as FIG. 2.

FIG. 5 represents a front elevation of an example of a turbine wheel of the second alternate embodiment of FIG. 4.

FIG. 6 represents a front elevation of a weight modified turbine wheel of the ball vibrator shown in FIG. 1

FIG. 7 represents a front elevation of an alternate weight modified turbine wheel of the ball vibrator shown in FIG. 1.

Figure 1:
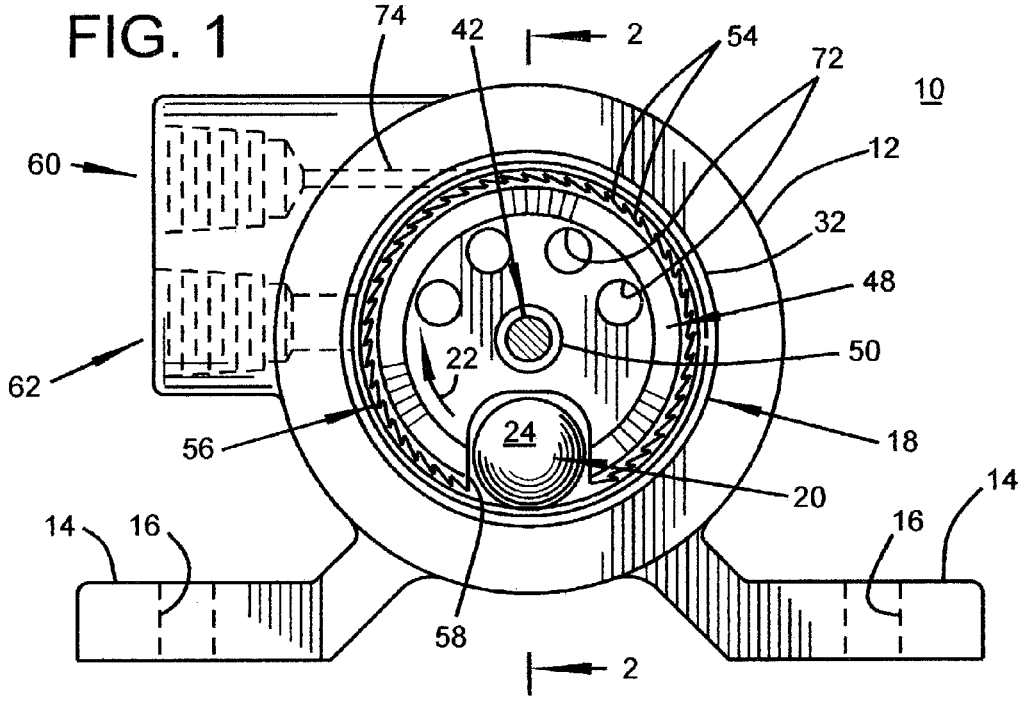
FIG. 1 represents a front elevation of a ball vibrator of the present invention, this view showing the interior of the housing.

In the following description and in the appended claims, various components, features and or details are identified by specific names for convenience. These names are intended to be generic in their application while differentiating between the various features, components and or details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention, as claimed. This invention may be incorporated into other structural forms than shown.

DETAILED DESCRIPTION OF THE INVENTION

Figure 2:
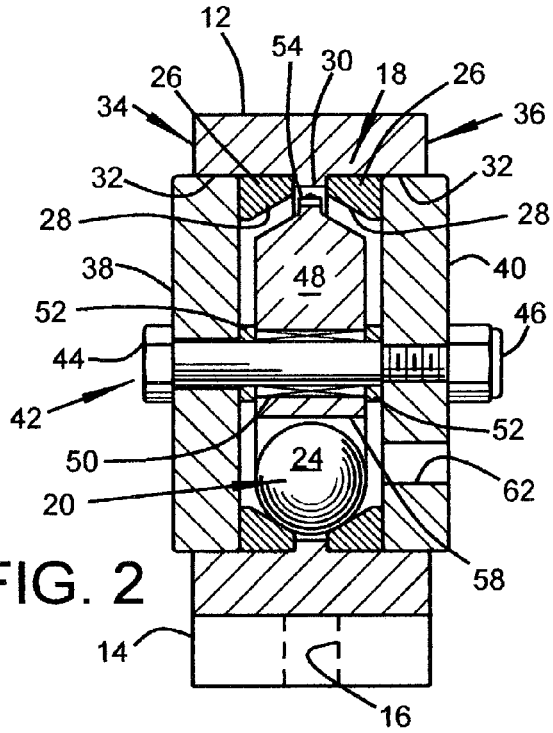
FIG. 2 represents a side elevation of the present invention, this view being in section and taken along line 2—2 of FIG. 1.

Referring to drawings and first to FIGS. 1 and 2., a ball vibrator assembly of the present invention is generally identified as 10. The ball vibrator assembly 10 includes a generally cylindrical housing 12 that is shown as having a pair of means for mounting or feet 14 that allow the assembly 10 to be removably attached to an item to be vibrated. Threaded fasteners, not shown, are inserted into the through apertures 16 of the feet 14 for the mounting thereof. The cylindrical housing 12 has a raceway 18 formed internally thereof for guiding a rolling member 20 along an orbital path 22. In this first embodiment of the present invention the rolling member is a ball 24. Typically, it is preferred that the raceway 18 be made of a pair of ring members 26 that are removably retained interior of the cylindrical housing 12 as more clearly seen in FIG. 2. Each ring member 26 is formed with a sloping inner diameter 28. The ring members 26 are positioned interior of the housing 12 so that the sloping inner diameters 28 are facing each other to form the raceway 18 that has a V-shaped configuration. The ring members 26 are usually separated a predetermined distance by a boss 30 that is formed interior of the housing 12. The bore 32 of the cylindrical housing 12 typically has a first end 34 and a second end 36 that are closed by a first end cap 38 and a second end cap 40. One or both of the end caps 38 & 40 may be removably retained thereon and therein by a shaft member 42. One non-limiting example of the shaft member 42 is a shoulder bolt 44 that is retained by a threaded nut 46 to form a sandwich of the first end cap 38, the second end cap 40, and ring members 26. The boss 30 acts as a locating means for the sandwiched members.

A first embodiment for mounting a turbine wheel 48 is more clearly seen in FIG. 2, The turbine wheel 48 is carried by and journalled on the shoulder bolt 44 by a anti-friction bearing 50. One non-limiting example of a anti-friction bearing 50 is a needle bearing. The turbine wheel 48 is centrally positioned interior of the housing 12 by a pair of spacers 52. Referring again to FIG. 1, the turbine wheel 48 has a plurality of blade members 54 formed along its outside diameter 56. The blade members 54 are arrayed for rotating the turbine wheel 48 when and while a stream of a gas is directed in a substantially tangential manner. The compressed gas is conducted into the housing by way of the inlet port 60 and then is exhausted from the housing at the outlet port 62. It is to be noted that the outlet port 62 may alternatively be positioned or integrally formed into either the first end cap 38 or the second end cap 40 as may be seen in FIG. 2. It is preferred that either the end cap 38 or 40 includes a locating means or key that is provided there-with for orienting the alternate outlet port 62 with respect the inlet port 60 of the housing 12. A recess portion or cavity 58 is formed into the turbine wheel 48 at a predetermined position along its outer diameter 56. The recess portion is selectively sized for allowing the rolling member 20 to reside therein while allowing the rolling thereof along the orbital path 22 around the shaft member 42. The outside diameter 56 of the turbine wheel 48 is contoured to follow the profile of the raceway 18 while providing a predetermined clearance there-between.

Figure 3:
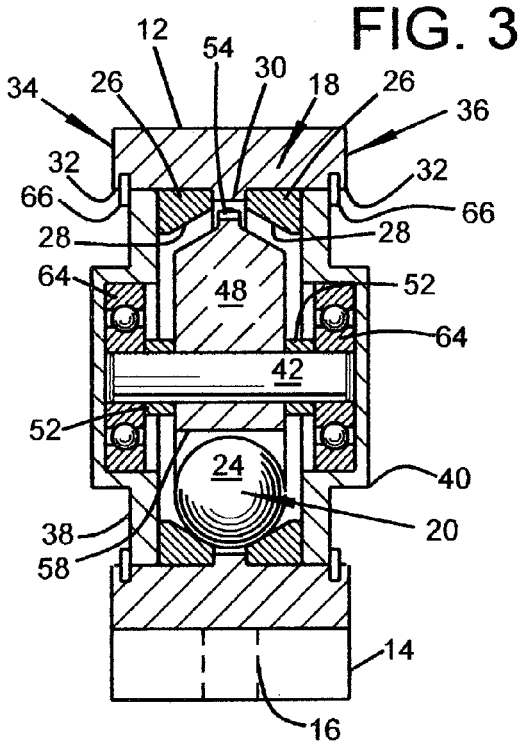
FIG. 3 represents a side elevation of a first alternate embodiment of the present invention, this view being in section and taken in the same direction as FIG. 2.

A second embodiment for mounting the turbine wheel 48 is more clearly seen in FIG. 3. The turbine wheel 48 is carried by and fixed to the shaft member 42 by a suitable locking means. The shaft member 42 is journalled in the first end cap 38 and the second end cap 40 by a pair of anti-friction bearings 64. The first end cap 38 and the second end cap 40 are removably retained in the ends 34 & 36 of the housing 12 by a retaining means 66. One non-limiting example of the retaining means 66 is an internal retaining ring that is seated in a groove. The turbine wheel 48 is centrally positioned interior of the housing 12 by a pair of spacers 52. Referring again to FIG. 1, the turbine wheel 48 has a plurality of blade members 54 formed along its outside diameter 56. The blade members 54 are arrayed for rotating the turbine wheel 48 when and while a stream of a gas is directed in a substantially tangential manner. As in the first embodiment described above, a recess portion or cavity 58 is formed into the turbine wheel 48 at a predetermined position along its outer diameter 56. The recess portion 58 is selectively sized for allowing the rolling member 20 to reside therein while allowing the rolling thereof along the orbital path 22 around the shaft member 42. The outside diameter 56 of the turbine wheel 48 in this second embodiment is also contoured to follow the profile of the raceway 18 while providing a clearance there-between.

Referring now to FIG. 4, a third embodiment of the present invention uses a roller 68 for the rolling member 26. This third embodiment may be adapted to either the shaft and journaling arrangement of the first embodiment of FIG. 2 or the second embodiment of FIG. 3. It is to be noted that the roller 68 may be of the cylindrical or spherical type. The ring members 70 are profiled to match the contour of the roller 68. The outside diameter 56 of the turbine wheel 48 in this third embodiment is also contoured to follow the profile of the ring members 70 while providing a clearance there-between.

Referring now to FIGS. 5 through 7, the turbine wheel 48 may be constructed a with weight modification means. One non-limiting example of a weight modification means is at least one cut out portion, recess and/or hole 72 for the balancing thereof so that eccentric or unbalanced forces are minimized on the bearings 50 or 64 thereby minimizing their wear. However, the weight modification means for the turbine wheel 48 may be in an unbalancing configuration by forming additional cut out portions, recesses and/or holes 72 thereby adding more eccentric force to the rolling member 20. Of course the anti-friction bearings would need to be sized to withstand the forces that are generated by the unbalanced turbine wheel 48.

IN OPERATION

The present invention is operated in a similar manner as conventional ball vibrators except that the noise generated and compressed fluid consumption is minimized for the vibratory forces generated.

A conduit is removably connected between the inlet port 60 and a source of compressed fluid. An exhaust conduit or muffler may be connected to the outlet port or exhaust 62. The compressed fluid, such as air, is injected into the housing 12 by way of an orifice 74. The injected fluid is directed to and towards either the blade members 54 or a rolling member 20, depending on the orientation of the vibrator of the present invention with respect to gravity when the ball is at rest. This introduction of the injected fluid causes rotation of the turbine wheel 48 with the rolling member 20 residing therein in an orbital path within the housing 12. The orbital path of the vibrator, as depicted in FIG. 1, is in a clock-wise direction around the shaft member 42. The rolling member 20 resting in the recess portion 58 begins movement as and when the turbine wheel begins its rotation or when directly acted upon by the introduction of the compressed gas or fluid into the housing 12. The full velocity of the turbine wheel 48 is realized in a short time after the rolling member 20 passes the orifice 74. The gas that is flowing interior of the housing 12 is exhausted through the outlet port or the exhaust 62. The rotation of the rolling member 20 creates a centrifugal force while maintaining contact with the raceway 18. The operation of the vibrator 10 of the present in terminated by shutting off the flow of the compressed fluid into the housing 12.

It is to be noted that the blade members 54 may be formed as a portion of the width of the turbine wheel 48 as seen in FIGS. 2 and 3. Alternatively, the blade members may be formed across the full width of the turbine wheel 48 as shown in FIG. 4. The blade members 54 may be straight, helical or V-shaped to suit the application.

Directional terms such as "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A compressed gas operated vibrator that includes: a cylindrical housing, having a raceway located therein, the raceway being sized for guiding a rolling member along an orbital path interior of the cylindrical housing, a first end cap for closing a first end of the cylindrical housing and a second end cap for closing a second end of the cylindrical housing, at least one of either the first end cap or second end cap being removably retained thereon, the cylindrical housing further including at least one inlet port for directing a flow of a compressed gas to and towards a selected point of the raceway, an outlet port for exhausting gas from the housing, and a turbine wheel that is carried on a shaft that extends from the first end cap to the second end cap, the shaft being selectively positioned for allowing rotation of the turbine wheel interior of the cylindrical housing, the turbine wheel having a plurality of blade members formed along its outer diameter, the turbine wheel further including a recess portion that is formed into its outer diameter, the recess portion being selectively sized for allowing the rolling member to reside therein while simultaneously allowing the rolling member to contact the raceway; and wherein, the turbine wheel with the rolling member residing in the recess portion therein rotates interior of the cylindrical housing by the action of the compressed gas thereby generating an unbalanced vibratory motion and the turbine wheel minimizing unwanted acceleration of the rolling member as and when the orbiting rolling member is directly acted upon by the flow of compressed gas at the location of the inlet port for minimizing damage to the rolling member and the raceway.

2. A compressed gas vibrator as recited in claim 1 wherein the rolling member is a ball.

3. A compressed gas vibrator as recited in claim 2 wherein the raceway includes a pair of race rings that are removably mounted interior of the cylindrical housing and each of the race rings have their opposite inner diameters formed with sloping raceway surfaces for providing a V-shaped profile for guiding the ball.

4. A compressed gas vibrator as recited in claim 3 wherein the profile of the outer diameter of the turbine wheel follows a contour of the V-shaped raceway while maintaining a predetermined clearance there-between.

5. A compressed gas vibrator as recited in claim 4 wherein the shaft is a shouldered and threaded fastener that retains the first end cap and the second end cap in a predetermined spaced relationship and the turbine is journalled on the shaft.

6. A compressed gas vibrator as recited in claim 3 wherein a bore of the cylindrical housing includes an annular boss for maintaining a predetermined spaced relationship between the pair of race rings.

7. A compressed gas vibrator as recited in claim 1 wherein the shaft is a shouldered and threaded fastener that retains the first end cap and the second end cap in a predetermined spaced relationship and the turbine wheel is journalled on the shaft.

8. A compressed gas vibrator as recited in claim 1 wherein the turbine wheel is fixed to the shaft member and one end of the shaft member is journalled in the first end cap and a distal end of the shaft member is journalled in the second end cap.

9. A compressed gas vibrator as recited in claim 1 the rolling member is a roller.

10. A compressed gas vibrator as recited in claim 9 wherein a bore of the cylindrical housing includes an annular boss for maintaining a predetermined spaced relationship between a pair of race rings, each of the pair of race rings being contoured to the shape of the roller for providing the raceway for the roller.

11. A compressed gas vibrator as recited in claim 9 wherein the blade members of the turbine wheel are the full width of the turbine wheel.

12. A compressed gas vibrator as recited in claim 9 wherein the shaft is a shouldered and threaded fastener that retains the first end cap and the second end cap in a predetermined spaced relationship and the turbine is journalled on the shaft.

13. A compressed gas vibrator as recited in claim 9 wherein the turbine wheel is fixed to the shaft member and one end of the shaft member is journalled in the first end cap and a distal end of the shaft member is journalled in the second end cap.

14. A compressed gas vibrator as recited in claim 1 wherein the turbine wheel further includes at least one cut out portion at a predetermined location for the balancing thereof.

* * * * *